US006163329A

United States Patent [19]

Venkataraman et al.

[11] Patent Number: 6,163,329

[45] Date of Patent: Dec. 19, 2000

[54] THERMAL HEAD PRINTER AND METHOD OF USING SAME TO PRINT ON A THERMOPLASTIC MEDIUM

[75] Inventors: Ravi Venkataraman; Paul Morgan, both of Cookeville, Tenn.

[73] Assignee: Identity Group, Inc., Cookeville, Tenn.

[21] Appl. No.: 08/990,954

[22] Filed: Dec. 15, 1997

[51] Int. Cl.[7] ..... B41J 2/32; B41J 3/407; B41K 1/50

[52] U.S. Cl. ..... 347/171; 101/379; 101/327

[58] Field of Search ..... 347/197, 171, 347/221; 400/601, 401.1, 120.01, 120.16; 101/379, 327

[56] References Cited

U.S. PATENT DOCUMENTS

| | | | |
|---|---|---|---|
| 3,742,853 | 7/1973 | Landsman . | |
| 3,779,779 | 12/1973 | Landsman . | |
| 4,064,205 | 12/1977 | Landsman . | |
| 4,725,853 | 2/1988 | Kobayashi et al. . | |
| 4,733,249 | 3/1988 | Iwamoto et al. . | |
| 5,181,787 | 1/1993 | Hosomi . | |
| 5,300,351 | 4/1994 | Takahashi et al. . | |
| 5,366,302 | 11/1994 | Masumura et al. . | |
| 5,414,450 | 5/1995 | Oshino et al. . | |
| 5,554,334 | 9/1996 | Kashio et al. . | |
| 5,559,545 | 9/1996 | Fuwa | 347/171 |
| 5,577,444 | 11/1996 | Toyama . | |
| 5,665,524 | 9/1997 | Kashio et al. . | |
| 5,677,721 | 10/1997 | Suzuki et al. . | |

FOREIGN PATENT DOCUMENTS

| | | | |
|---|---|---|---|
| 0853004 | 7/1998 | European Pat. Off. . | |
| 9-109535 | 4/1997 | Japan | 347/171 |
| 9-216447 | 8/1997 | Japan | 347/171 |

*Primary Examiner*—Huan Tran

[57] ABSTRACT

The present invention is directed to a thermal printer for printing on thermoplastic foam to form a relief image which is comprised of open cells in the area that is the transfer ink enclosed or sealed cells which is to be impermeable to ink or other print medium. The present invention also includes the method of using the thermal head printer which preferably includes cooling the thermoplastic foam prior to forming the image thereon and using a lubricant to pass the thermoplastic form across the thermal printhead.

19 Claims, 4 Drawing Sheets

THERMAL HEAD PRINTER AND METHOD OF USING SAME TO PRINT ON A THERMOPLASTIC MEDIUM

FIELD OF THE INVENTION

The present invention relates generally to a thermal head printer and a method for using the thermal head printer for printing an image on a thermoplastic medium, and more particularly to a printer and method of forming an image on a thermoplastic foam, the image being comprised of a relief image of open cells and a background image of closed cells.

BACKGROUND OF THE INVENTION

There are a number of traditional ways of forming images on a printing plate. These include, but are not limited to, molding, photoflash imaging, and thermal imaging. The present invention is directed broadly to the area of thermal imaging or thermography. Thermal imaging or thermography is a recording process wherein an image is generated by the use of image wise modulated thermal energy. Traditional, "direct thermography" refers to a method whereby a visible image pattern is formed by the image wise heating of a recording material containing matter that by chemical or physical process changes color or optical density. Most of the direct thermographic recording materials are of a chemical type. On heating the recording material to a certain conversion temperature, an irreversible chemical reaction takes place and a colored image is produced.

In recent years, the field of manufacturing or producing printing plates such as rubber stamps has experienced rapid advancement, especially in the methods used to fabricate the stamps. Resinous relief printing plates, planographic printing plates, and intaglio printing plates all formed using photosensitive resins now enjoy widespread use. In addition, a number of methods are known for forming printing plates using stencil images. These methods generally involve the use of a thermal printer or a wire dot printer to form a stencil image on a sheet, which is then utilized as a printing plate.

Another method of forming relief plates involves forming a printing plate by heat pressing a photosensitive resinous printing plate with an image plate, thereby forming a relief image on the photosensitive material. This method involves a complicated process for producing either a metal printing plate or a photosensitive resinous printing plate. In addition, the use of a press machine or heated roller is required for this process. Further, positioning the embossing plate properly on a plate prior to pressing can be challenging to even those highly skilled in the art, and deviation from the proper position can readily occur.

As the use of relatively simple printing systems has expanded, the need for a simple, yet reliable, method of printing a printing plate has come into existence. In an attempt to address this need, U.S. Pat. No. 5,665,524 (which is hereby incorporated herein in its entirety by reference) describes a printing plate which is formed from an open celled thermoplastic medium wherein the open cells are sealed upon exposing to energy rays. The methods described in this reference generally require the presence of a negative to block photorays which results in a portion of the photosensitive thermoplastic medium remaining unhardened by blocking the energy rays, and a separate portion which is hardened by exposure to the energy rays. The exposed portion forms a background of the image to be formed on the stamp. The background portion prevents the transfer of ink from the thermoplastic foam to the receiving medium (i.e. paper) in these regions. It is speculated in U.S. Pat. No. 5,665,524 that an expensive laser system may be driven to seal predetermined portions of the foam to form the background image. In addition, this reference places a great deal of emphasis on forming the open-cell image in the same plane as the background image by sealing only a surface layer of open cells, thereby forming a plate having little or no relief.

SUMMARY OF THE INVENTION

The present invention is directed to a printer for printing on a thermoplastic medium. The printer is generally comprised of a housing or frame which functions as a support structure for the mechanical pieces of the printer. The printer includes a thermal head pivotally attached to the frame which functions as a source of thermal energy to be placed in direct contact with selected portions of the thermoplastic medium. The term "direct thermal contact" as defined herein with regard to the formation of an image on a thermoplastic medium is very similar to "direct thermography" as known in the related art, except that the recording material is an open-celled thermoplastic material and the chemical or physical change is the closing or sealing of the open-cells to form a background image. When the thermal head is placed in "direct" contact with the thermoplastic medium, the thermal head heats and melts selected portions of the thermoplastic medium. The heated or melted portions of the thermoplastic medium are sealed (the open cells of the thermoplastic medium are closed), which results in the formation of a background image or non-image on the thermoplastic medium. The sealed or closed portions are substantially impermeable to the printing fluid (ink). Although the printer is described in specific detail and with reference to specific embodiments herein, it is to be understood that the present invention should not be so limited and can be incorporated into a large number of different embodiments with each of them sharing the direct contact of a thermal head printer on thermoplastic foam, whereby a relief is formed on the thermoplastic foam.

The present invention provides numerous advantages over the related art. It is a continuous feed system which allows an infinite variety of sizes (length, width, thickness) to be processed. The system is very fast and there is a great deal of flexibility in the image printed on the printing plate due to the limitless numbers and types of software from which an image can be printed. The present invention reduces the cost associated with the formation of printing plates by, for example, eliminating the need for a mask to block photorays, allowing "off-the-shelf" software to be utilized, increasing speed of production, and eliminating cost prohibitive production equipment.

These and other features of the invention will be more fully appreciated with reference to the figures and the disclosure to follow:

DETAILED DESCRIPTION OF THE PRESENT INVENTION

Figure 1:
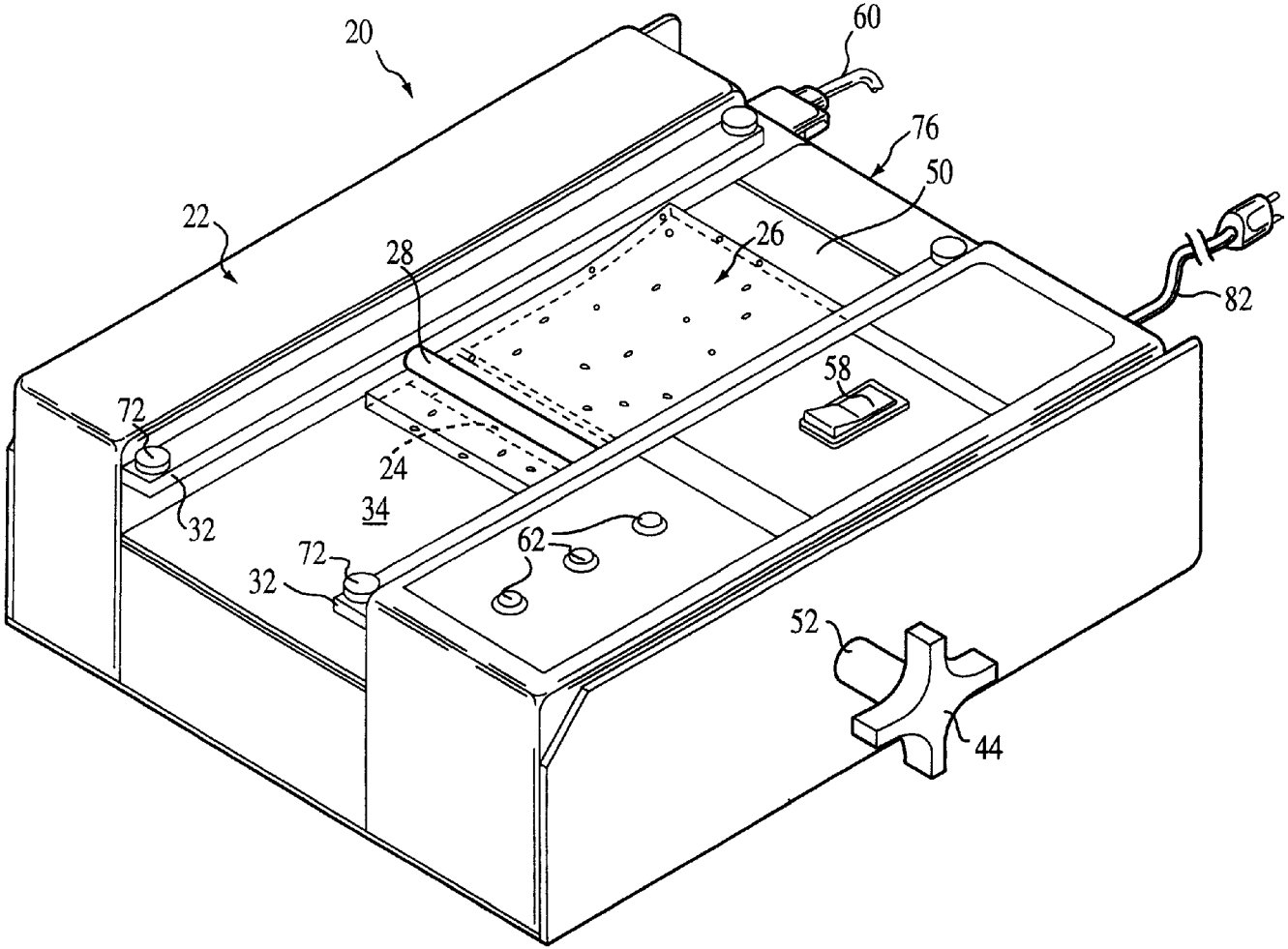
FIG. 1 is an isometric view of a preferred embodiment of the thermal printer illustrated with a piece of thermoplastic medium on the receiving bed of the printer.

Disclosed herein is a printer for printing on a thermoplastic medium. In general, the printer includes a driving mechanism operatively connected to a frame for driving the thermoplastic medium across and in contact with a thermal head. The driving mechanism is preferably a cylindrical platen or roller which frictionally engages the thermoplastic medium and feeds the thermoplastic medium into the printer and across the thermal head. Preferably, the printer includes a cam assembly which is utilized in biasing the thermal head against the thermoplastic medium. The thermal head engages the thermoplastic medium on the surface which is to be printed on and the platen or roller pushes the thermoplastic medium against the thermal head. The printer also preferably includes adjustable guide rails operatively connected to the frame which are designed to adjustably accommodate a variety of widths and thicknesses of thermoplastic medium. The guide rails assist in properly guiding the thermoplastic medium onto the receiving bed and across the thermal head. The printer may optionally include a cooling plate operatively connected to the frame or separately located, wherein the cooling plate cools a portion of the thermoplastic medium prior to that portion being put in contact with the thermal head.

The background portion of the thermoplastic medium which is melted and sealed is done so at least at a surface layer, and more preferably, is melted at sufficient depth to form the open cell image as a relief image. Not sealing the entire space behind the open cells allows the open cells behind the sealed cells to be repositories of printing fluid. The background portion corresponds to the non-image portion of the original image and substantially prevents transfer of printing material through the thermoplastic medium in these areas. The areas of the thermoplastic medium which are not in contact with the heated elements of the thermal print head are generally formed as a mirror image of the image to be printed on a print material, and as a mirror image of the image as viewed on a screen. The image formed on the thermoplastic medium which is to function as a print face is comprised of open cells. Therefore, when placed in contact with a material to be printed on, ink or similar material is transferred from the open cells of the thermoplastic medium to the paper in the desired pattern. Thus, when the thermoplastic medium, including image, is mounted as a printing plate, typically as a hand stamper, the open cell portions of the thermoplastic medium are able to transfer ink to the material to be printed on, i.e., paper, and the sealed portions prevent the transfer of ink. The ink may be contained completely within the piece of thermoplastic foam which forms the stamp or may be fed into the stamp from an ink reservoir.

As an additional and more preferred embodiment of the present invention, the printing device for printing on open-cell thermoplastic foam includes a signal interface assembly for receiving a signal corresponding to an image to be formed on the open-cell thermoplastic foam and a thermal print head driven by the signal. The thermal print head prints a background image on the thermoplastic foam by heating the thermoplastic foam and sealing at least a surface layer of the open-cell thermoplastic foam. This allows an image to be formed of open cells and a non-image or background to be formed of closed cells. The signal interface assembly is comprised of a communication port, preferably both a parallel port and a serial port which are adapted to receive information, preferably from a microprocessor based graphics system. One of the more advantageous aspects of the present invention is that essentially any software can be used to generate the image to be formed on the thermoplastic medium. As long as the software can interface with a standard printer (i.e. laser or dot matrix), it can be utilized with the present invention to form a printing plate. A "line" of an image seen on the view screen of the microprocessor normally results in this "line" being formed as a mirror image of the line, and the mirror image is formed of open cells on the printing plate. Similarly those portions of the graphics which are non-images (i.e. white on a black and white monitor) result in the non-image formed of closed cells. The printing device is further comprised of a means for positioning the thermal print head in thermal contact with the open-cell thermoplastic foam, and a drive mechanism for moving the foam across the print head. The thermoplastic foam is placed into a contact position with the thermal print head via the drive mechanism and a cam assembly which is positioned to push the thermal print head against the open-cell thermoplastic foam.

Further discussed herein are methods of forming a pattern on an open-cell printing plate which is comprised of generating a signal corresponding to the pattern to be formed on the open-cell printing plate, receiving the signal corresponding to the pattern to be formed on the open-cell printing plate, and driving a thermal head printer to heat the open-cell printing plate to seal at least a layer of cells which correspond to a background of the pattern formed on the open-cell printing plate. Preferably, the printing plate is formed from a piece of thermoplastic foam and the pattern, that is, the unheated open cell portions are formed as raised relief images. To accomplish this, it is preferable to seal a plurality of layers of open cells so that the background portion is formed of a plurality of layers of closed cells. The method may also included, but does not require, a step of cooling a portion of the foam sheet prior to heating to form the negative or background image in conjunction with or followed by pressing the thermal head printer against the foam sheet with sufficient force to cause the pattern to be formed as a raised or relief image of open cells.

It has also been found that utilizing a lubricant of some type facilitates the movement of the thermoplastic foam sheet through the printer and across the thermal printhead. Utilization of a lubricant normally results in a sharper image being formed on the printing plate. Also, as discussed above, cooling the thermoplastic foam material prior to inserting it into the printer results in a cleaner and clearer image being formed on the thermoplastic foam, and the combination of cooling and lubricating produces the sharpest printing plates. Utilizing a liquid coolant, either by immersing or spraying is contemplated. It is also contemplated to utilize a combined liquid surface coolant. Although not intending to be bound by theory, it is believed that the formation of a sharper image is a result of preventing either the foam or the lubricating material from transferring heat to that portion of the thermoplastic medium on which the open-celled image is to be formed. It is further theorized that without prior cooling, some of the open cells within the relief may partially collapse or close, resulting in at least partial deformation of the open cell image. While the lubricant normally takes the form of a liquid or an aerosol, thermoplastic foam and the thermal print sheet of Mylar® polyester film inserted between them has been proven effective. As used in this disclosure, the term "about" means +/−10% of a numerical value, i.e. "about 20%" means 18–22%.

Figure 6:
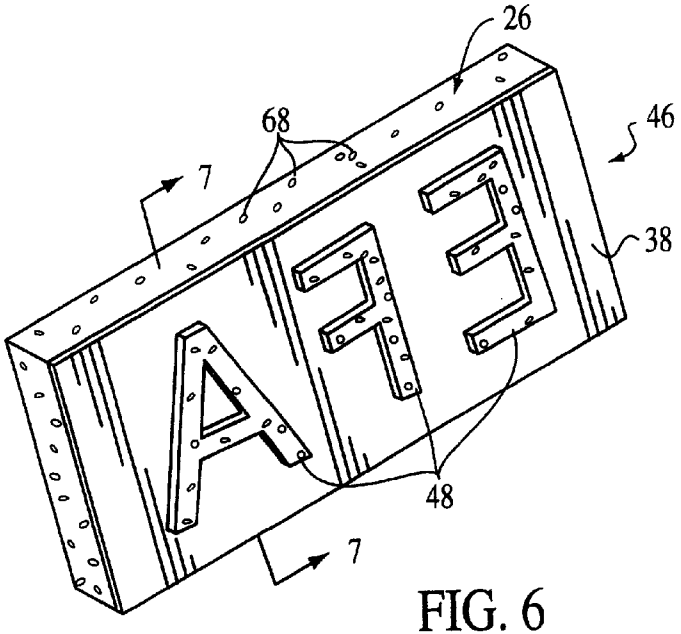
FIG. 6 is an isometric view of a printing plate illustrating the raised open-cell ink face area and the sealed background image.

In order that the invention herein may be described and understood more fully, the following detailed description is set forth. Referring to FIG. 1, a printer 20 for printing an image 48 on a thermoplastic medium 26 or thermoplastic foam 26 is illustrated. The printer 20 is very generally comprised of a frame or housing, 22 which houses the mechanical assembly of the thermal head printer 20 described herein which includes at least a thermal head or thermal print head 24 pivotally attached to the housing 22. Thermal head 24 is pivotally mounted so that it may be biased against the thermoplastic foam 26 in order for thermal energy to be applied directly to the thermoplastic medium 26. Pivoting of the thermal print head is not required, but is preferred to allow the print head 24 to be out of contact with the thermoplastic medium 26 or with the platen roller 28. As will be discussed further herein, cam 30 functions to bias or press the thermal head 24 against the thermoplastic medium 26 in order to allow the thermal energy to be placed in direct contact with the thermoplastic medium 26. This allows the production of open-.celled image 48 and background image 38 on printing plate 46 (FIG. 6). In the released or non-printing mode, cam 30 is adjusted via rotatable handle 44 and cam lever shaft 52 so that the thermal printhead 24 is not in thermal contact with the thermoplastic medium 26. Thermal contact, as used herein, generally refers to "direct" thermal imaging or direct thermography.

The "direct" thermal imaging of the present invention is very similar to that known in the related art except that it is adapted to utilize thermoplastic medium 26 as the print medium. "Direct" thermal printing results when a thermal printhead 24 receives an imaging signal in the form of electrical pulses from a driver circuit 64. Thermal printhead 24 generally consists of microscopic heat resistor elements which convert the electrical energy into heat via the jewel effect. The electrical pulses thus converted into thermal signals manifest themselves as heat transferred to the surface of the thermal recording material, in this case, thermoplastic medium 26. As will be described herein below, melting occurs at the surface of the thermoplastic tedium 26 resulting in a background image or non-image 38 formed of sealed or closed cells and image 48 of open cells to be formed. Preferably, the areas of thermoplastic medium 26 which are to form background image 38 reach a temperature sufficient to cause melting or sealing of the cells in these areas, more preferably in the range of about 190–230° F. and most preferably in the range of 200–220° F. It is preferable that the thermoplastic medium obtains a surface temperature in the range of about 150–230° F. with sufficient transfer of heat to the thermoplastic medium 26 being obtained by "squeezing" the thermoplastic medium 26 between the thermal head 24 and the platen or roller 28. Of course, the operational temperature and pressure applied to the thermoplastic medium 26 may vary depending on a particular thermoplastic medium 26 being used. The image signals for modulating the current in the microresistors in the thermal print head 24 are obtained directly for example from scanning devices or from intermediate storage means (e.g., magnetic disk or tape or optical disk storage medium) optionally linked to the digital image work station or microprocessor (not shown) via connector cord 60 wherein the image information can be processed to satisfy a particular need.

Figure 8:
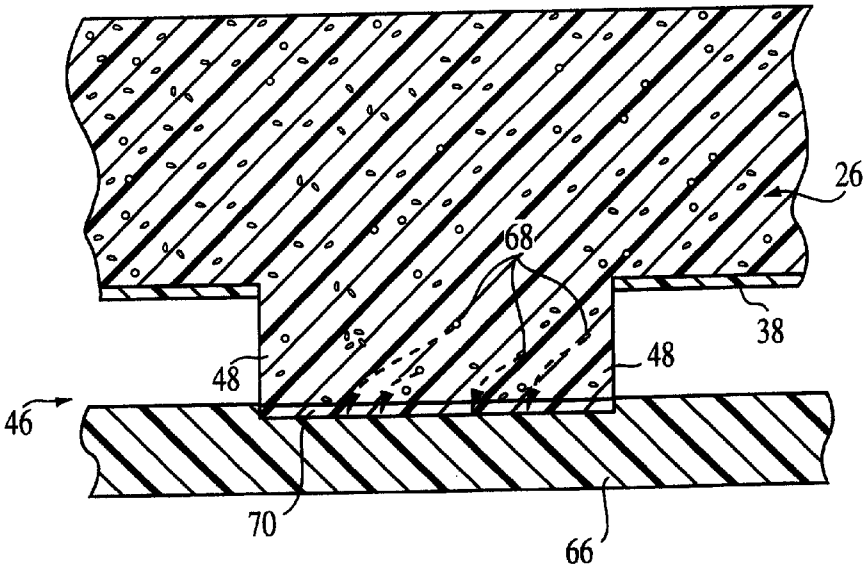
FIG. 8 is a highly enlarged cross section through line 7—7 of FIG. 7 illustrating a letter of the image plate being pressed against absorbent material to be printed on wherein the capillary action of ink flow is illustrated via dashed arrows for purposes of clarity.
Figure 7:
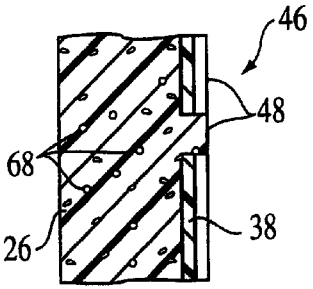
FIG. 7 is a partial cross section through line 7—7 of FIG. 6 enlarged area of a letter in the printing plate.

Thermoplastic medium 26 can be selected from a number of thermoplastic resins, including by way of example, and without limitation, polyolefins, polyurethanes, polyacetals, polyethylene, polystyrene, and polyamide and combinations thereof. A thermoplastic medium 26 which has been found to be particularly useful for the present invention is an ethylene-olefin copolymer available, for example, from the Exxon Chemical Company. It is preferable that the thermoplastic medium 26 be "open celled" prior to the application of heat. "Open-cell" refers to the characteristic of the thermoplastic medium 26 wherein the cells of the thermoplastic medium 26 have interstitial space which may be filled with ink. The open cells 68 are illustrated in FIGS. 6–8 as large "pores". "Open Cell" refers to the porous structure of the thermoplastic medium 26, and to a condition of the thermoplastic medium 26 which allows the ink to be at least temporarily stored in the thermoplastic medium 26 and transferred to absorbent material 66. Although, as illustrated and described herein, material 66 is described as absorbent, this is simply the most common application of the present invention. However, the present invention may be used to print on glass, PVC, and other "non-absorbent" materials. "Open cells" include microporous structures which are sufficiently sized to store or transfer ink. Individual open cells 68 are able to communicate directly with other cells or pockets in the thermoplastic foam. This allows a liquid print medium (ink) or an emulsion resin to pass from cell 68 to cell 68. This is illustrated by the dotted arrows in FIG. 8. As the ink leaves the open cells 68 of the print plate 46, an ink image 70 is formed on material 66, normally ink absorbing paper. When thermal energy is applied to the surface of the thermoplastic foam 26, the surface of the thermoplastic foam 26 melts or solidifies resulting in a melted portion 38 of the thermoplastic foam 26 which eliminates communication between the open cells 68 of the print plate 46 and the print medium 66 due to the impermeable portion 38. Since portion 38 is substantially impermeable to liquid transfer, these areas are suitable in functioning as non-image areas which do not transfer ink to paper 66 as a background.

Figure 4:
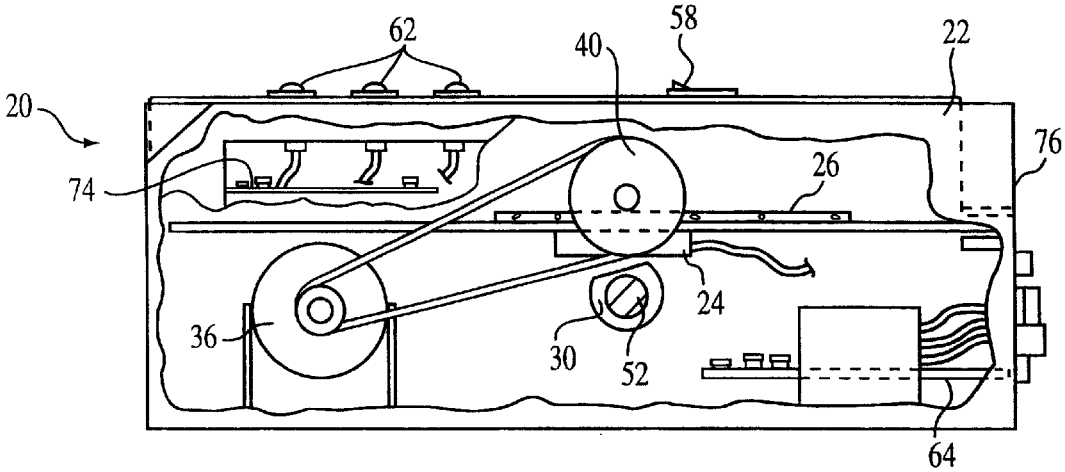
FIG. 4 is a right side view of a preferred embodiment of the thermal head printer with a cut-away portion illustrating the interior assembly of the printer.
Figure 5:
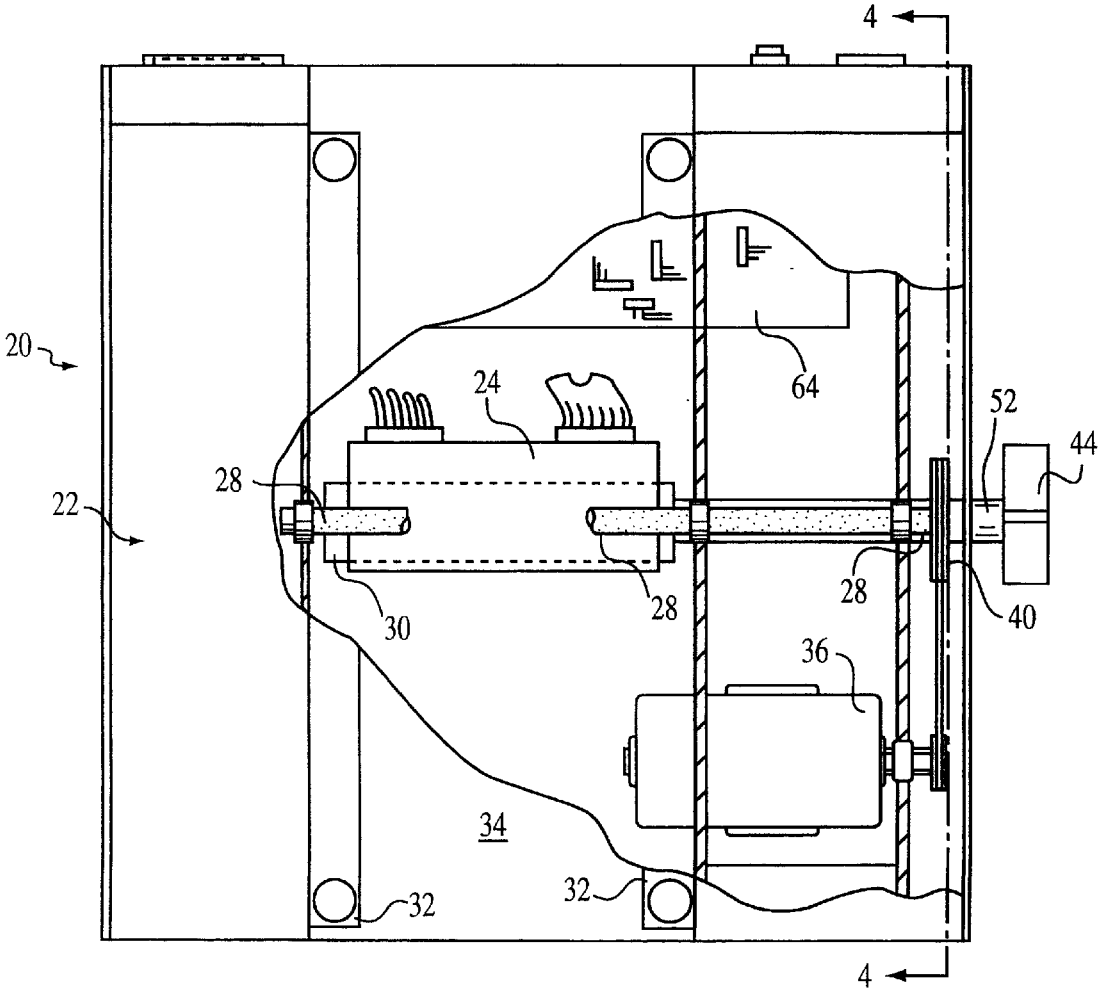
FIG. 5 is a top plan view of a preferred embodiment of the thermal head printer with a cut-away portion to illustrate the interior assembly of the printer.

As stated above, melting or solidifying a surface portion of the thermoplastic medium 26 results in a background image 38 of the thermoplastic foam, substantially preventing communication between the underlying open cells and the paper 66. This is clearly illustrated in FIG. 8. To form the image 48 on the thermoplastic medium 26, the thermoplastic medium 26 is received by the receiving bed 34 of the printer 20 and fed into printer 20. Receiving bed 34 is generally a planar surface but may also be comprised of a convoluted path common in thermal head printers used for processing paper. It should be noted, however, that if a convoluted path is used as receiving bed 34, distortion in the resulting image 48 and lack of flexibility in the thermoplastic medium 26 are some of the problems encountered. Edge-fixed thermal print heads are preferred because the majority of the head is planar and thus the thermoplastic medium 26 does not encounter a convoluted path prior to an image being formed thereon. Adjustable guide rails 32 assist in guiding the thermoplastic medium 26 onto the receiving bed 34 and into the region where the thermal head 24 is to be placed in contact with the surface of the thermoplastic medium 26 where the image 48 and non-image 38 are to be formed. The width of the thermoplastic medium 26 utilized depends on the width and number of stamps being formed along the surface area and the width of the thermal head 24. Typically, the width of the thermoplastic foam varies from about ¼ inch to about 4½ inches, with about 4 inches, being most common. The length of the thermoplastic medium 26 can be essentially infinite and the printer 20 can be adapted to run continuous long lengths of thermoplastic medium 26 or a single stamp having very minimal length (i.e., about ¼ inch to about 1 inch). The thickness or depth of the thermoplastic foam is preferably in the range of about 0.1 inch to about 0.5 inches, more preferably about 0.15 inches to about 0.3 inches, and most preferably about 0.25 inches. The guide rails 32 are placed over the roller 28 so that the thermoplastic medium 26 is capable of being placed in frictional engagement with the platen roller 28 which allows the platen roller 28 to move the thermoplastic foam 26 along the receiving bed 34 and into contact with thermal print head printer 34. As best shown in FIG. 4, the thermal head 24 is pivotally mounted to housing 22 to be pivoted and biased against the thermoplastic medium 26 via cam 30 which is driven by cam shaft 52 via rotatable handle 44. Pulley system 40 drives platen roller 28. Pulley system 40 is itself driven by a step motor 36 at a predetermined speed based on the image 48 and background image 38 to be formed on .he thermoplastic foam 26. The speed is normally communicated via drives circuit 64 and the print operation is monitored via control monitor board 74. As briefly discussed above, the driving mechanism or platen roller 28 drives the thermoplastic medium 26 across the thermal head 24 via frictional engagement at a predetermined rate and the thermal head 24 is biased against thermoplastic medium 26 via biasing means 30 which is illustrated as cam 30. Cam 30 is moved into place via rotatable handle 44 which when adjusted, moves cam shaft 52. To enhance frictional engagement between the thermoplastic material 26 and platen roller 28, platen roller 28 is preferably textured or knurled.

Figure 2:
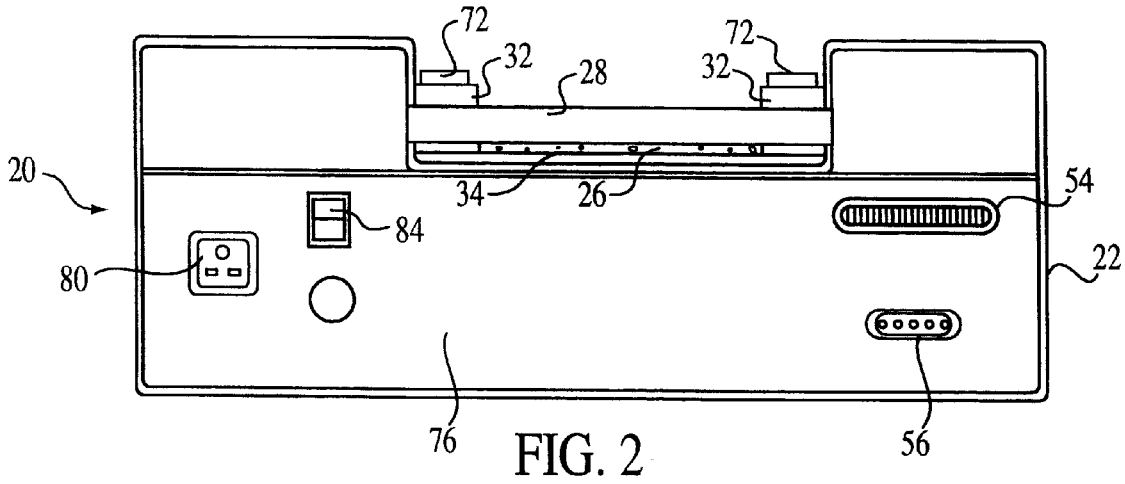
FIG. 2 is a rear view of a preferred embodiment of the thermal head printer of the present invention.
Figure 3:
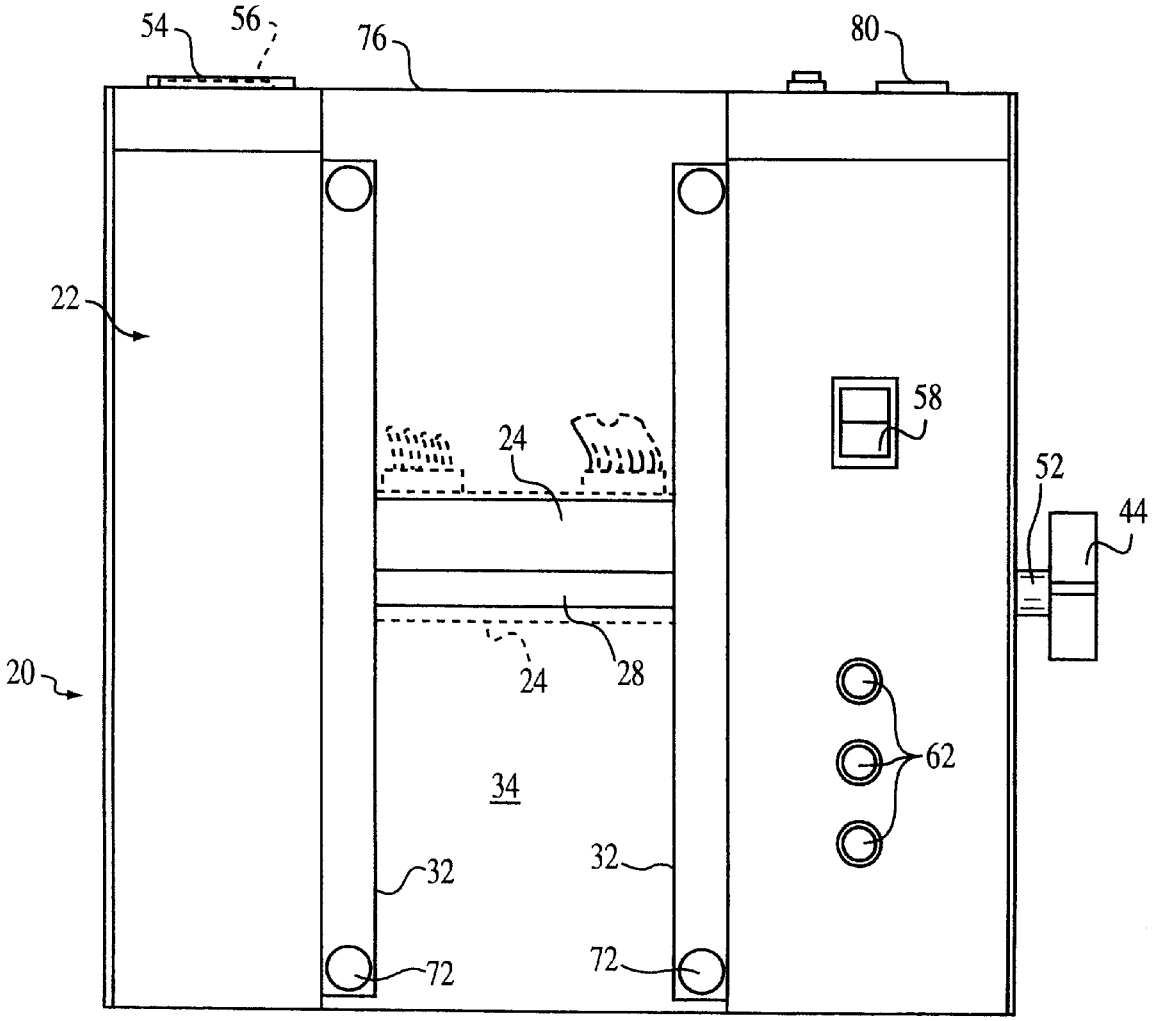
FIG. 3 is a top plan view of a preferred embodiment of the thermal head printer of the present invention.

Now referring to FIG. 2, the printer 20 is illustrated having both a parallel port 54 and a serial port 56 to allow communication with a variety of input sources such as scanners or graphical imaging software which resides on a microprocessor (not shown) via connector 60. Rear panel 76 includes a power jack 80 for connection to a power source via power cord 82. Fuse 84 provides protection from electrical overload. The communication ports provide means to communicate with printer 20. FIG. 3 illustrates the positioning of the on/off button 58 and star shaped handle 44 which biases the cam 30 against the thermal head 24 via cam shaft 52. Indicator lights 62 provide a visual indicator of the operation of printer 20. Of course, the placement of the button 58 and like devices are not crucial to the operation of the printer 20.

Referring in particular to FIGS. 6–8, the printing plate 46 formed by the direct thermal imaging process described herein is illustrated. On the surface of the printing plate 46, which is in direct contact with the thermal head 24, thermoplastic foam 26 is melted or solidified resulting in a melting of the open cells of the thermoplastic foam 26 to form a non-image 38 which is impermeable to the transfer of liquid or resin while the image portion 48 (lettering) maintains an open cell structure which permits the transfer of liquid or resin from the thermoplastic foam 26 to the material 66 to be printed on. This results in the image signals from the microprocessor to be printed on the print material 66. Pressure exerted on the thermoplastic foam 26 by the platen roller 28 results in portions of the thermoplastic foam 26 which are heated and melted being on a lower plane than the open celled structures which form the image 48. Thus the image 48 is formed as a relief. As shown in FIG. 8, after the desired image 48 is formed on the printing plate 46, printing ink is infused into the open cells of the printing plate 46. Ink can fill the entire open celled structure of the thermoplastic medium 26 except the melted or solidified surface portion 38 and can communicate with the paper or print medium 66 except in those areas 38 that are melted and sealed. It may also be possible to infuse the ink prior to forming image 48 and background 38. The ink is illustrated as moving via capillary action along dotted arrows in FIG. 8. This is illustrated this way simply for clarity. The ink moves from one cell 68 to the next and may in fact take a very circuitous route to the material to be printed on 66.

Preferably, printer 20 includes enough memory to store one complete image (the entire background 38 and open cell image 48) received from a microprocessor. This is preferable, because printing the image a line at a time may result in distortion in the open cell image 48 on printing plate 26. While not meant to be bound by theory, it is speculated that the distortion is a result of either a temperature gradient being set up from one line to the next on the thermoplastic foam 26 during the print process or expansion of the thermoplastic foam 26 as it moves through the printer 20.

Preferably, a cooling plate 50 integral with the thermal head printer 20 or cooling station set apart from the thermal head printer 20 may be used in conjunction with the thermal head printer 20 to cool the thermoplastic medium 26 prior to printing an image (background image 38 and open-cell image 48) on the thermoplastic medium 26. The use of a cooling plate 50, or separately cooling the thermoplastic foam 26 prior to inserting the thermoplastic foam 26 through the printer 20 and in contact with the thermal printer head 24 results in a much sharper image (sharper distinction between open cell image 48 and background image 38) being formed due to the fact that the thermoplastic foam 26 and/or any lubricants used to facilitate the processing of the thermoplastic medium 26 are largely prevented from transferring heat to the open celled image 48 portion of the thermoplastic medium 26.

It has also been found that a lubricant, alone or in combination with the cooling step, results in a clearer printing plate 46. For example, a liquid lubricant may be cooled prior to being applied to the thermoplastic medium 26 in order to function as a combination coolant/lubricant. A lubricant allows the thermoplastic foam 26 to pass through printer 20 without overexposure and closure of open cells 68 which are to be a portion of open cell image 48. Fatty acids, especially lower chain length fatty acids, have been shown to be suitable lubricants. Additionally, other types of lubricant may be used, for example, ethylene glycol and glycerol have been successfully used.

The present invention is also directed to a method of forming a pattern on a printing plate wherein the pattern consists of an open-celled portion 48 and closed or sealed portion 38. A signal which corresponds to the pattern to be formed on the printing plate 48 is normally generated with a computer graphic program or other microprocessor system which sends information to driver circuit 64 which in turn communicates with the thermal head 24 and platen roller 28. This provides a large amount of flexibility in the image to be formed on the printing plate 46. Once the signal is received, the corresponding pattern (image 48 and background image 38) is formed on the printing plate 46. Thermal head 24 of the printer 20 is driven to heat an open-celled thermoplastic medium 26 in order to seal at least a single-surface layer of cells which correspond to the background 38 of the pattern to be formed on the printing plate 46. Preferably prior to heating the thermoplastic foam 26, the thermoplastic foam 26 is cooled in order for a sharper image or distinction between open-cell image portion 48 and closed cell portion 38 to be formed. It is preferable that the open-cell image portion 48 is formed as a relief pattern and therefore does not exist on the same plane as the melted portion or closed cells 38 which form the background image on the printing plate 46.

Although the invention has been described in terms of particular embodiments in an application, one of ordinary skill in the art, in light of this teaching, can generate additional embodiments and modifications without departing from the spirit of, or exceeding the scope of, the claimed invention. For instance, it is within the scope of the present invention to utilize an automatic sensor to determine the thickness and width of the thermoplastic medium 26 and to use a variety of temperatures and speed of processing depending on the thermoplastic medium 26. Additionally, information regarding the status of the machine and the production commands can be part of a Liquid Crystal Display ("LCD") format or Graphical User Interface format ("GUI"). Accordingly it is to be understood that the drawings and the descriptions herein are proffered by way of example only to facilitate comprehension of the invention and should not be construed to limit the scope thereof.

What is claimed is:

1. A printer for printing on a thermoplastic medium, comprising:

a frame;

a thermal head attached to said frame for applying thermal energy to said thermoplastic medium to form a sealed portion and an unsealed portion on a surface of said thermoplastic medium, said sealed portion of the thermoplastic medium being substantially non-planar with said unsealed portion of the thermoplastic medium;

a biasing means for biasing said thermal head against said thermoplastic medium; and adjustable guide rails operatively connected to said frame, said guide rails adapted to accommodate a selected width of the thermoplastic medium and for guiding the thermoplastic medium across the thermal head.

2. A printer for printing on a thermoplastic medium, comprising a frame;

a thermal head attached to said frame for applying thermal energy to said thermoplastic medium to melt selected portions of the thermoplastic medium; and a cooling means operatively connected to the frame, said cooling means cooling a portion of the thermoplastic medium prior to the thermal head applying thermal energy to the thermoplastic medium.

3. The printer of claim 2, wherein at least a surface layer of said thermoplastic medium is sealed upon melting.

4. The printer of claim 2, wherein the portions of the thermoplastic medium which are melted correspond to areas which prevent transfer of liquid printing material through the thermoplastic medium.

5. The printer of claim 4, wherein the thermoplastic medium is substantially free of melted portions in areas corresponding to a predetermined image adapted to transfer ink.

6. A printing device for printing on open-cell thermoplastic foam, comprising:

adjustable guide rails for receiving said thermoplastic foam; and a thermal print head driven by a signal, said thermal print head printing a background image on said thermoplastic foam by heating the thermoplastic foam and sealing at least a surface layer of said open-cell thermoplastic foam whereby an image is formed of open cells.

7. The printing device of claim 6, further comprising a means for positioning said thermal print head in thermal contact with said open-cell thermoplastic foam.

8. The printing device of claim 7, further including a feeding mechanism for feeding the thermoplastic foam into a position to be contacted by the thermal print head.

9. The printing device of claim 7, wherein said means fox positioning said thermal print head in thermal contact with said open-cell thermoplastic foam is comprised of a cam assembly which biases said open-cell thermoplastic foam against the feeding mechanism.

10. The printing device of claim 6, wherein said thermal print head is capable of printing on pre-inked foam.

11. The printing device of claim 6, further including a means for lubricating said open-cell thermoplastic foam during printing.

12. The printing device of claim 6, wherein said background image is substantially non-planar with respect to said image formed of open cells.

13. A printing device for printing on open-cell thermoplastic foam, comprising:

a signal interface assembly for receiving a signal corresponding to an image to be formed on the open-cell thermoplastic foam;

a thermal print head driven by said signal, said thermal print head printing a background image on the open-cell thermoplastic foam by heating the open-cell thermoplastic foam and sealing a surface layer of the open-cell thermoplastic foam whereby an image is formed of open cells; and a cooling means for cooling the open-cell thermoplastic foam prior to the open-cell thermoplastic foam being heated by the thermal print head.

14. The printing device of claim 13, wherein said signal interface assembly is comprised of a communication port.

15. A method of forming a pattern with an image and a background on a printing plate comprised of an open-celled thermoplastic medium, said method comprising:

driving a thermal head printer to heat the open-celled thermoplastic medium to seal at least a single layer of cells corresponding to the background of the pattern formed on the printing plate, wherein said background of the pattern is substantially non-planar with respect to the image of then pattern; and inserting a lubricant between said open-celled thermoplastic medium and said thermal head printer.

16. The method of claim 15, wherein said lubricant is selected from the group consisting of a sheet of polyester film, an aerosol, and a liquid.

17. A method of forming a pattern with an image and a background on a printing plate comprised of a pre-inked open-celled thermoplastic medium, said method comprising:

driving a thermal head printer to heat the pre-inked open-celled thermoplastic medium to seal at least a single layer of cells corresponding to the background of the pattern formed on the printing plate, wherein said background of the pattern is substantially non-planar with respect to the image of the pattern.

18. A method of forming a pattern on a printing plate comprised of an open-celled thermoplastic medium, said method comprising generating a signal corresponding to the pattern to be formed on the printing plate;

receiving the signal corresponding to the pattern to be formed on the printing plate;

driving a thermal head printer to heat the open-celled thermoplastic medium to seal at least a single layer of cells corresponding to a background of the pattern; and cooling a portion of the open-celled thermoplastic medium prior to heating that portion of the open-celled thermoplastic medium.

19. The method of claim 18, wherein said printing plate is a sheet of open-celled thermoplastic foam.

* * * * *